US005857266A

United States Patent [19]

Raybould et al.

[11] Patent Number: 5,857,266

[45] Date of Patent: Jan. 12, 1999

[54] HEAT EXCHANGER HAVING ALUMINUM ALLOY PARTS EXHIBITING HIGH STRENGTH AT ELEVATED TEMPERATURES

[75] Inventors: Derek Raybould, Denville; Jerry Capriotti LaSalle, Montclair, both of N.J.

[73] Assignee: AlliedSignal Inc., Morristown, N.J.

[21] Appl. No.: 692,555

[22] Filed: Aug. 6, 1996

Related U.S. Application Data

[60] Provisional application No. 60/007,813 Nov. 30, 1995.

[51] Int. Cl.[6] ..... B23D 15/26

[52] U.S. Cl. ..... 29/890.054; 165/133

[58] Field of Search ..... 165/133, 134.1; 29/890.054, 890.03; 228/183

[56] References Cited

U.S. PATENT DOCUMENTS

| | | | |
|---|---|---|---|
| 3,852,873 | 12/1974 | Chertit | 29/890.054 |
| 4,214,925 | 7/1980 | Arita et al. | 29/890.054 |
| 4,410,036 | 10/1983 | Kanada et al. | 165/134.1 X |
| 4,626,295 | 12/1986 | Sasaki et al. | 29/890.054 |
| 4,636,356 | 1/1987 | Iwasaki et al. | 420/532 |
| 4,673,551 | 6/1987 | Yoshihiko et al. . | |
| 4,926,242 | 5/1990 | Itoh et al. | 357/81 |
| 5,011,547 | 4/1991 | Fujimoto et al. | 148/24 |
| 5,217,547 | 6/1993 | Ishikawa et al. | 148/552 |
| 5,260,142 | 11/1993 | Kawabe et al. | 165/134.1 X |
| 5,292,595 | 3/1994 | Yamauchi et al. | 165/134.1 X |
| 5,295,302 | 3/1994 | Takai et al. | 29/890.054 |
| 5,351,750 | 10/1994 | Garcia | 165/133 |
| 5,720,340 | 2/1998 | Ohara et al. | 29/890.054 |

FOREIGN PATENT DOCUMENTS

| | | |
|---|---|---|
| 0 241 125 A1 | 10/1987 | European Pat. Off. . |
| 56-044742 A | 7/1981 | Japan . |
| 61-079752 A | 8/1986 | Japan . |
| 61-119645 A | 10/1986 | Japan . |
| 62-096637 A | 10/1987 | Japan . |
| 01 159 343 A | 6/1989 | Japan . |
| 06 212 329 A | 8/1994 | Japan . |

*Primary Examiner*—I. Cuda
*Attorney, Agent, or Firm*—Felix L. Fischer; John R. Rafter

[57] ABSTRACT

A heat exchanger includes one or more parts composed of a braze clad aluminum alloy having a composition defined essentially by the formula: Al 1.1% Mn 1.1% Mg 0.15 Cu and being brazed to other aluminum parts. The heat exchanger exhibits usable strength at operating temperatures ranging up to 232° C. [450° F], and is especially suited for use in the charge air cooler of a diesel engine.

4 Claims, 1 Drawing Sheet

HEAT EXCHANGER HAVING ALUMINUM ALLOY PARTS EXHIBITING HIGH STRENGTH AT ELEVATED TEMPERATURES

CROSS REFERENCE TO RELATED APPLICATIONS

This application claims the benefit of U.S. Provisional Application No. 60/007,813, filed Nov. 30, 1995.

BACKGROUND OF INVENTION

1. Field of the Invention

The present invention relates to aluminum heat exchangers and parts thereof having improved properties, and more specifically to such heat exchangers and parts which exhibit increased strength at elevated temperatures.

2. Description of Related Art

Several aluminum alloys are currently used in construction of heat exchangers. The 20 most common are alloys typified by an alloy bearing designation AA 3003. This alloy has low strength, and is easily formed to sheet, fins and tubes. Slightly higher strengths are obtained by heat exchanger parts constructed using alloy AA 3005. The AA 3003 alloy has good corrosion resistance and was initially employed in radiators. Thereafter it was used in construction of heat exchangers such as charge air coolers (inter-coolers) on automobiles equipped with turbochargers.

Turbochargers use the engine exhaust gas to turn a turbine which drives a compressor forcing air into engine's piston cylinder chamber, increasing combustion efficiency which improves fuel efficiency and performance. The compression of the intake air increases its temperature, somewhat reducing the beneficial effects of the air compression. For this reason, it is beneficial to cool the intake air compressed by the turbocharger prior to its injection into the cylinder chamber. This is done by employing an air to air heat exchanger (known in the automobile and truck industry as an inter-cooler or charge-air-cooler). The now cooled and compressed air results in maximum performance derived from turbocharging, lowering emission levels and improving fuel efficiencies. In North America turbochargers are generally used only on specialty automobiles, but they are employed on almost all heavy trucks and construction vehicles. Because the benefits of turbocharging increase as the pressure of the intake air increases, there is a desire to further increase the output pressure of turbochargers. Such a pressure increase is accompanied by a proportional increase in gas temperature, in accordance with Boyle's gas law. This, in turn, places increased temperature demand on the charge-air-coolers.

The new 2nd & 3rd generation alloys that have been developed for use in heat exchangers had as objectives, improved corrosion resistance, improved brazeability and increased strength. Excellent corrosion resistance was obtained by increasing the % Cu to the existing alloys. Heat exchangers constructed using the modified alloy 3190 exhibited improved strength; a similar alloy is MD 356, which also has Ti additions to further increase its corrosion resistance.

In heat exchanger and radiator construction, the alloys AA 3003, AA 3005, MD 356 and 3190 are the core alloys currently used; the compositions of these alloys are given in Table 1. These structural core alloys are joined into a component by brazing. The braze alloys are clad on one or both sides of the core alloy. The braze alloys typically have an Al—Si eutectic base, which falls between the 7% Si or 12% Si composition range. For radiator applications, the water side is clad with "pure" aluminum that further improves the corrosion resistance. Cladding thickness varies from 5 to 15% of the core alloy thickness. Because significant diffusion occurs when the braze clad Al—Si melts it is necessary that the braze clad be compatible with the core alloy. The solidus of the core alloy must also be above the braze temperature. These requirements limit the type of alloy that may be used as the core.

TABLE I

| Alloy | Mn [wt %] | Mg [wt %] | Cu [wt %] | Si [wt %] | Fe [wt %] | Cr [wt %] | Zn [wt %] | Ti [wt %] |
|---|---|---|---|---|---|---|---|---|
| AA3003 | 1.0–1.5 | 0.1 max | 0.05–0.20 | 0.6 max | 0.7 max | — | 0.1 max | — |
| AA3005 | 1.0–1.5 | 0.20–0.60 | 0.3 max | 0.6 max | 0.7 max | 0.1 max | 0.25 max | 0.1 max |
| 3190 | 1.0–1.5 | 0.3–0.7 | 0.3 max | 0.4 max | 0.4 max | — | — | — |
| MD356 | 0.8–1.3 | 0.4–0.6 | 0.30–0.55 | 0.25 max | 0.4 max | — | 0.1 max | 0.11–0.20 |

The 2nd & 3rd generation aluminum alloys, such as the proprietary MD356 and 3190 alloys are limited to temperatures of 177° C. [350° F], as are the AA3003 & AA3005 alloys on which they are based. This temperature limitation seriously restricts the potential benefits of turbocharging systems. Metals other than aluminum could be used for charge air coolers to improve the elevated temperature strength, just as copper is used for radiators. However, the increase in weight encountered in use of those metals would offset any benefit derived from the increased power afforded by their ability to operate at higher temperatures.

A charge air cooler or intercooler is conventionally comprised of a side plate, header, tubes and fins. Hot gas is fed to the tubes by the header which is basically a manifold that is held in place by a side plate. The fins are thin sheets attached to the tubes in order to promote cooling. The cool air flows over the fins and the outside of the tubes, while the hot gas flows inside the tubes and the manifold. The tubes and manifold are therefore hotter than the fins. All of these parts are brazed together, with the result that any alloy used must be able to withstand an approximate 600° C. braze cycle.

AlliedSignal Turbocharging Systems Division (ASTS) charge-air-coolers are constructed using the 3190 alloy for the header and tubes and AA3 003 for the less demanding fins. These give satisfactory service under current operating conditions. However, it has been found by ASTS that the 3190 and similar alloys tend to fail by thermal fatigue when used in charge-air-coolers designed for temperatures in excess of 177° C.

ASTS have calculated the stress and temperature distribution in a charge air cooler on a Freightliner DDA-960-470 HP engine subject to the most severe conditions it would encounter during passage over the Rocky Mountains using the Loveland Pass. It was found that the first tube connection to the header would experience the maximum temperature and stress. The stress at this location is higher, because it is the location at which the header is connected to the cooler side plate, at this location the header is not only cooler, but is also firmly fixed in position. The stress experienced occurs not only during the acceleration cycle, but also during deceleration, when the temperature differential is reversed. ASTS found that the temperature reaches 405° F. and the effective stress is 4.0 ksi. Comparison with fatigue curves shows that theoretically the header tube connection will fail by a low cycle failure after an unacceptable 6,000 "Loveland Pass" cycles. Such failures were found by ASTS in the new aircooler intended for operation at over 177° C. Another failure mode is bending of the side plate. Analysis indicates that although the temperature of the side plate is only around 150° C., the stress is high, with calculated values of 9 ksi, hence its failure mode is typical of an overloaded structure rather than a fatigue failure.

Heat exchangers constructed using the stronger AA 6000 type alloys have been proposed; but these devices have been found to over-age at temperatures above 177° C., thereby causing rapid (<100 hours), deleterious loss of mechanical properties with time.

There remains a need in the art for a heat exchanger, the parts of which exhibit useable strength after long term exposure to temperatures above 177° C. and after experiencing a standard braze cycle.

SUMMARY OF THE INVENTION

The invention provides a heat exchanger having one or more parts composed of an aluminum alloy having a composition consisting essentially of: Al 1.1% Mn 1.1% Mg 0.15 Cu. The heat exchanger is capable of sustained operation above 177° C., while maintaining acceptable corrosion resistance. The alloy of which the heat exchanger is comprised has not previously been considered for heat exchanger applications, since the lower temperature properties exhibited thereby were not as beneficial for such applications as those of conventional aluminum heat exchanger alloys. It has been discovered that heat exchanger parts such as headers, tubes and side plates, composed of alloys having a composition defined by the formula Al 1.1% Mn 1.1% Mg 0.15 Cu are especially suited for applications at temperatures of about 232° C. This improved performance is due to an improvement in the elevated temperature strength which increase the fatigue life of the heat exchanger tubes and avoids the deformation of the side plate. The capability of the heat exchanger to operate in the 232° C. temperature regime without loss of strength, even after exposure to the 600° C. brazing temperature, makes it especially well suited for use in heat exchanger applications such as truck diesel engine charge-air-coolers, and the like.

BRIEF DESCRIPTION OF THE DRAWING

The invention will be more fully understood and further advantages will become apparent when reference is made to the following detailed description of the preferred embodiments of the invention and the accompanying drawing in which.

DETAILED DESCRIPTION OF THE INVENTION

Figure 1:
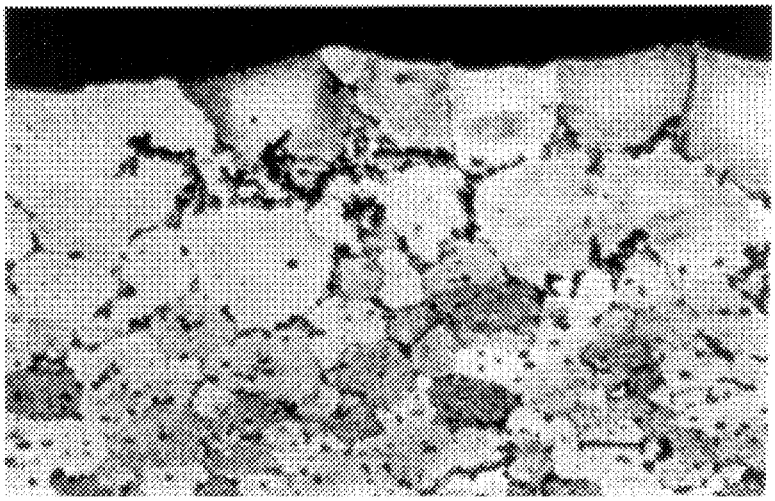
FIG. 1 is a photomicrograph of a sample composed of alloy core A with a layer of AlSi braze clad, the scale line shown in the Figure being 50 micrometers long.

While not being bound by theory, heat exchangers constructed using one or more parts composed of an alloy defined essentially by the formula Al 0.7–1.6% Mn 0.8–2.0% Mg 0.05–0.5 Cu exhibit improved performance at elevated temperature due to the presence of 0.8 to 2.0 wt % Mg, which is not present in conventional heat exchanger alloys listed in Table 1. The composition centered about 1.1% Mg is particularly useful in that it provides a balance between high temperature strength, formability, and corrosion resistance. Additions of Mg have not previously been thought to be beneficial to heat exchanger alloys for elevated temperature applications.

Other important alloying elements include copper in the range of 0.05 to 0.50 wt % and 0.7 to 1.6 wt % Mn. Trace additions of other elements, either as contaminants or additions to provide corrosion protection, may optionally be present. Such additions are acceptable so long as they do not significantly reduce the solidus temperature.

The composition range for an alloy that has been found to be especially well suited for manufacture of heat exchanger parts in accordance with the present invention is Al 0.9–1.2% Mg 0.9–1.3% Mn 0.05–0.25% Cu. An alloy having a somewhat similar composition has been used previously as a beverage can material. Neither it nor other alloys, such as AA 3004, have been disclosed as being suitable for use in applications requiring 232° C. [450° F.] operating temperatures.

The invention will be more fully understood and further advantages become apparent when reference is made to the detailed description and the accompanying examples.

EXAMPLE 1

Sheet of conventional braze core alloys coated with an AlSi braze coat and also sheet of the investigated alloy, with the I.D. of A, having the composition of Al 1.1% Mn 1.1% Mg 0.2% Cu 0.2% Si 0.5% Fe were machined to test coupons.

The test coupons were subjected to a standard braze cycle used to manufacture charge air coolers. The brazing cycle consisted of 1) Placement in a vacuum chamber subsequently evacuated to $10^{-5}$ Torr. 2) Heating to 100° C. and holding at temperature for 15 min. 3) Ramping the temperature to 595° C., with temperature not exceeding +5° C. of the target temperature. 4) Holding at 595° C. for 8 minutes. 5) Cooling to 540° C. and holding for 5 min. 6) Backfilling the chamber with a nitrogen quench, reducing the temperature to 250° C. in less than 1 minute. 7) Cooling the chamber to less then 100° C. before the quench terminated. Subsequent to the braze cycle, the coupons were aged within 1 hour after being removed from the vacuum chamber. Aging treatment consisted of 180° C. for approximately 16 hours.

The coupons were then tested via a conventional tensile test at room temperature, 177° C. and 232° C. During the elevated temperature test the coupons were held at temperature for 30 minutes prior to testing. The results of these tests are shown in Table 2. As shown by the Table, test coupons composed of the investigated alloy A exhibit a significantly superior strength at 232° C., effectively equal to that of M356 and 3109 at 177° C. In addition, the 3190 at 177° C. has a yield stress of 8.4 ksi, making failure of the side plate by plastic deformation probable since it experiences a stress conditions of 9 ksi and temperature of around 150° C. In contrast alloy A has a yield stress of 12 ksi even at 232° C.

TABLE 2

| Alloy | Braze Coat | R.T. Y.S. [ksi] | R.T. U.T.S. [ksi] | R.T. El [%] | 177° C. YS [ksi] | 177° C. UTS [ksi] | 177° C. El [%] | 232° C. Y.S. [ksi] | 232° C. UTS [ksi] | 232° C. El [%] |
|---|---|---|---|---|---|---|---|---|---|---|
| 3003 | Yes | 12.4 | 18.6 | 18.8 | 8.7 | 12.7 | 21.0 | 6.0 | 8.3 | 22.0 |
| MD356 | Yes | 9.7 | 23.8 | 18.5 | 10.8 | 17.7 | 21.9 | 8.7 | 11.3 | 16.6 |
| 3190 | Yes | 9.2 | 23.1 | 17.5 | 8.4 | 17.0 | 21.0 | 9.8 | 15.0 | 21.0 |
| Alloy A | No | 16.2 | 27.7 | 21.5 | 11.7 | 25.3 | 21.0 | 12.1 | 19.5 | 26.5 |

EXAMPLE 2

The same test procedure described in Example 1 was carried out, except that the investigated alloy A now had a braze coat applied. This was done to determine potential braze interaction with the core alloy, which could compromise its strength. Although the strength of the alloys are reduced compared to the data in Table 2, the investigated alloy is still by far the strongest alloy at 232° C. Most important, the strength of the braze clad sample is the same as an uncoated sample, Table 3.

The good interaction of the AlSi braze clad and the core alloy A is shown in Fig.

TABLE 3

| Alloy | Braze coat | R.T. Y.S. [ksi] | R.T. U.T.S. [ksi] | R.T. El [%] | 232° C. Y.S. [ksi] | 232° C. UTS [ksi] | 232° C. El [%] |
|---|---|---|---|---|---|---|---|
| AA3003 | Yes | 12.0 | 18.0 | 18.0 | 5.0 | 8.0 | 23.0 |
| MD356 | Yes | 9.7 | 23.8 | 18.5 | 10.2 | 10.8 | 11.6 |
| 3190 | Yes | 11.2 | 22.3 | 14.9 | 10.7 | 11.3 | 17.5 |
| Alloy A | Yes | — | — | — | 13.5 | 13.9 | 11.8 |
| Alloy A | No | 16.2 | 27.7 | 21.5 | 13.8 | 14.2 | 49 |

EXAMPLE 3

This example demonstrates that beneficial strength levels are retained after long term temperature exposure. Samples exposed in the braze furnace at the same time as those in Example 2 were placed together in a furnace at 232° C. and held for 100 hours. They were removed from the furnace and tensile tested at 232° C. As in all prior elevated temperature tests, the samples were held 30 minutes at temperature to ensure temperature stability . The measured properties are listed in Table 4. As in the previous two examples, the elevated temperature properties of samples composed of alloy A are clearly superior. The tensile strengths exhibited by the samples are substantially the same with or without the AlSi braze coat.

TABLE 4

| Alloy | Braze coat | 232° C. 30 m YS [ksi] | 232° C. 30 m UTS [ksi] | 232° C. 30 m El [%] | 232° C. 100 hr Y.S. [ksi] | 232° C. 100 hr UTS [ksi] | 232° C. 100 hr El [%] |
|---|---|---|---|---|---|---|---|
| AA300 | Yes | 5.0 | 8.0 | 23.0 | 6.0 | 6.3 | 22.3 |
| MD356 | Yes | 10.2 | 10.8 | 11.6 | 9.8 | 9.9 | 13.0 |

TABLE 4-continued

| Alloy | Braze coat | 232° C. 30 m YS [ksi] | 232° C. 30 m UTS [ksi] | 232° C. 30 m El [%] | 232° C. 100 hr Y.S. [ksi] | 232° C. 100 hr UTS [ksi] | 232° C. 100 hr El [%] |
|---|---|---|---|---|---|---|---|
| 3190 | Yes | 10.7 | 11.3 | 17.5 | 7.5 | 8.9 | 21.0 |
| A | Yes | 13.5 | 13.9 | 11.8 | 9.9 | 10.3 | 15.3 |
| A | No | 13.8 | 14.2 | 49.5 | 10.2 | 11.5 | 39 |

EXAMPLE 4

This example also demonstrates that beneficial strength levels are retained after long term temperature exposure. It endeavors to remove some of the variability in properties measured at 232° C. The variation is believed to be due to small changes in the test temperature having a large effect on the properties measured. To avoid this possibility a samples forming a batch were exposed to 232° C. for 100 hours at the same time. The samples were then tested at room temperature. As shown in Table 5, the properties of the samples composed of alloy A are clearly superior.

TABLE 5

| Alloy | Braze coat | R.T. Y.S. [ksi] | R.T. U.T.S. [ksi] | R.T. El [%] | R.T. after 100 hrs 232° C. Y.S. [ksi] | R.T. after 100 hrs 232° C. UTS [ksi] | R.T. after 100 hrs 232° C. El [%] |
|---|---|---|---|---|---|---|---|
| MD356 | Yes | 9.7 | 23.8 | 18.5 | 14.8 | 21.3 | 16.1 |
| Alloy A | No | 16.2 | 27.7 | 21.5 | 14.8 | 24.7 | 22.6 |

EXAMPLE 5

The same test procedure described in Example 1 was performed, except that several batches of samples were exposed to the braze cycle and then tested as a batch. Data for these samples is set forth in Table 6. Sufficient samples were tested in different batches that the repeatability of the data could be obtained. As shown by Table 6, there is more variability in the data at 232 than 177° C. Presumably this is due to the alloys being more susceptible to small variations in the test temperature at the higher temperature, as indicated in Example 4. Even so, at both 177 and 232° C. samples composed of alloy A are clearly superior. The yield strength at 232° C. for samples composed of alloy A is close to the yield strength at 177° C. for samples composed of MD356 and 3190. Values in ( ) are the standard deviation.

TABLE 6

| | | R.T. | | | 177° C. 30 min | | | 232° C. 30 min | | |
|---|---|---|---|---|---|---|---|---|---|---|
| Alloy | Braze coat | Y.S. [ksi] | U.T.S. [ksi] | El [%] | YS [ksi] | UTS [ksi] | El [%] | Y.S. [ksi] | UTS [ksi] | El [%] |
| AA3003 | Yes | 12.4 (3.0) | 18.6 (0.3) | 18.8 | 8.8 (1.4) | 12.7 (0.9) | 21.0 | 5.9 (0.1) | 8.3 (0.2) | 23.0 |
| MD356 | Yes | 9.8 (0.5) | 23.8 (0.1) | 15.5 | 10.8 (0.9 | 17.7 (0.3) | 14.0 | 8.8 (0.5) | 11.3 (0.1) | 17.0 |
| 3190 | Yes | 11.2 (0.2) | 22.4 (0.1) | 15.0 | 11.6 (0.6 | 19.0 (0.1) | 17.5 | 9.7 (0.6) | 14.8 (2.4) | 21.0 |
| Alloy A | No | 14.9 (1.1) | 26.6 (1.5) | 21.9 | 12.3 (0.8 | 24.4 (0.8) | 25.0 | 11.1 (0.9 | 17.1 (1.9) | 40.0 |

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A method for operating a charge-air-cooler comprising the steps of forming a header from a core alloy having a composition defined essentially by the formula: Al 0.7–1.6% Mn 0.8–2.0% Mg 0.05–0.5 Cu;

forming at least one tube from said core alloy clad with an AlSi alloy;

brazing said at least one tube to said header at a temperature above 550° C.;

connecting said charge-air-cooler to an outlet of a turbocharger compressor and operating said charge-air-cooler at temperatures between about 177° C. and 232° C. for a sustained period of time.

2. A method as defined in claim 1 further comprising the step of aging said brazed tube and header within about 1 hour of the braze cycle at a temperature of about 180° C. for about 16 hours.

3. A method for operating a charge-air-cooler comprising the steps of forming at least one tube from a core alloy having a composition defined essentially by the formula: Al 0.7–1.6% Mn 0.8–2.0% Mg 0.05–0.5 Cu;

forming a header from said core alloy clad with an AlSi alloy;

brazing said at least one tube to said header at a temperature above 550° C.;

connecting said charge-air-cooler to an outlet of a turbocharger compressor and operating said charge-air-cooler at temperatures between about 177° C. and 232° C. for a sustained period of time.

4. A method as defined in claim 3 wherein the core alloy consists essentially of Al 1.1% Mn 1.1% Mg 0.15 Cu.

* * * * *